United States Patent [19]

Wurtz

[11] 3,941,357

[45] Mar. 2, 1976

[54] METHOD AND APPARATUS FOR MIXING VISCOUS MATERIALS

[75] Inventor: William O. Wurtz, Paramus, N.J.

[73] Assignee: Willow Technology, Inc., New York, N.Y.

[22] Filed: Oct. 7, 1974

[21] Appl. No.: 512,822

[52] U.S. Cl. ..... 259/104

[51] Int. Cl.[2] ..... B01F 7/04

[58] Field of Search ..... 259/104, 6, 5, 21, 40, 259/41, 64, 103, 102, 119, 118

[56] References Cited

UNITED STATES PATENTS

| | | | |
|---|---|---|---|
| 1,370,893 | 3/1921 | Komarek | 259/104 |
| 2,570,042 | 10/1951 | West | 259/104 |
| 2,591,601 | 4/1952 | Peters | 99/348 |
| 2,794,626 | 6/1957 | Sterritt | 259/104 |
| 2,861,786 | 11/1958 | Madsen | 259/104 |

*Primary Examiner*—Robert W. Jenkins

*Attorney, Agent, or Firm*—Allison C. Collard

[57] ABSTRACT

A method and apparatus for mixing viscous materials in a double arm mixer having a container with a pair of spaced apart shafts pivotably disposed through the container and a plurality of mixing plows connected to the periphery of each shaft in spaced apart relationship. When the shafts are rotated in opposite directions, the working tools force the viscous material to the bottom of the container so that at its densest point, it interacts between the shafts before it is divided. The velocity of the individual particles varies in proportion to their distance from the axis from each of the shafts so that the shafts produce a radial inversion on a random basis as the particles are moved. The centrifugal force causes a radial shifting of the material from the axes of each shaft toward a path of higher velocity before the particles are divided. This results in uniform shear with a random division of all of the particles being mixed.

10 Claims, 10 Drawing Figures

METHOD AND APPARATUS FOR MIXING VISCOUS MATERIALS

The present invention relates to a dual shaft or double arm mixing method and apparatus.

More specifically, the present invention relates to a dual shaft mixer (dryer-reactor) which is well suited for mixing (drying-reacting) heavy, viscous, tacky materials. More particularly, and additionally, the present invention relates to a dual shaft mixer (dryer-reactor) that not only can handle heavy, tacky, viscous materials, but also can incorporate fillers and fibers into these materials without disadvantage.

In the U.S. Pat. No. 2,679,385, issued May 25, 1954, a mixing apparatus is disclosed which comprises a vessel for receiving the material to be mixed, and agitating and impelling means in the form of double-sided plough-share-like elements. Each element is tapered towards its front and comprises a body of substantially triangular cross section, with a peripheral convex face tapered in the direction of the front end. The side surfaces are concave and symmetrically disposed.

In providing application engineering service for over a ten-year period for this mixing apparatus, the applicant investigated and found many successful applications for this mixer. This was accomplished through a field test program in the potential customer's plant with the majority of test work being in the area of dry to dry mixing, dry to liquid mixing, and some light to medium viscosity liquid mixing. Attempts to mix heavy, viscous, tacky materials failed.

The mixing of viscous materials, where the apparent viscosity exceeds 100,000 centipoises, has received little attention. Additionally, very little work has been done in the area of viscous liquid or semi-solid mixing where the apparent viscosity exceeds 1,000,000 centipoises. Accepted "selection guides" indicate that mixing apparatus previously used for these viscous fluids are limited to extruders, special extruder types, roller mills, small heavy duty pony mixers, and double arm mixers. When fillers and fibers, such as asbestos, Fiberglas, sisal and the like are used, the choice is generally limited to a double arm mixer. For double arm mixers, different styles of agitators are offered with either overlapping or tangential operation. To provide different mixing characteristics, sigma type blades, 135° spiral, 180° spiral, double nobben, masticator, wing type, and serrated blades as working tools are offered. In all of these cases, mixing and dispersion is achieved through a combination of stretching, folding, kneading, and tearing actions, primarily as masses of material. For example, in the popular sigma blade mixer, the folding and compressing (kneading) action is accomplished by pressing the material against the wall of the tank and adjacent material. As the mixing tools rotate, they tear loose portions of the mix, carrying these portions to other parts of the tank, thus redistributing the contents as a small mass. The sigma pitched agitators provide movement of the material from each end of the tank to the center.

The above mixers however have severe limitations. The close tolerances required to provide high shear result in the breakdown of fibrous material when the fibers are incorporated into viscous semi-solids. For example, when resins are reinforced with Fiberglas, broken fibers will reduce the strength of the finished product. Additionally, their action is one of non-uniform shear, particularly since some material does not circulate well, and therefore provides "dead" areas.

The uniformity of shear for mixing apparatus has been little explored because the viscous behavior of most industrial materials is quite complex in relationship to other variables and is not readily understood. The vast majority of mixed fluids in practically every branch of industry, save the petroleum, are non-Newtonian fluids, and they are the rule rather than the exception. With non-Newtonians, the apparent viscosity changes with changing rates of shear. There is a poor understanding of the relationship between mixing, blending, or coalescing action and non-uniform shear with resultant variations of the viscosity of end products. The practical implications of non-uniform shear, when related to mixing action, are of great importance to quality control or the successful manufacture of products.

In examining the design characteristics of mixers presently offered to industry, and following particle streamlines, with for example a color tracer, some particles follow short velocity paths returning quickly to the shearing tool, while others follow longer paths, generally along the walls of the tank, and slowly return to the shearing tool. Also, as particles, or groups of particles are sheared, the mechanical work input is converted into heat energy, thereby raising their temperature. Since most fluids become thinner as their temperature increases, with the relationship being exponential in nature, the temperature change due to higher shear also changes the viscosity of that group of particles. One is therefore faced with non-uniform shear, non-uniform work input, and temperature and viscosity changes all within the same batch of material, thereby affecting its quality in service (applying, coating, dipping), its degree of polymerazation, emulsification, or homogenization plus its solids content.

In attempting to add fillers and fibers to viscous fluids, non-uniformity of shear affects a mixers ability to separate and wet fibrous materials and results in lumps, "fish eyes", or "bird nests". Additionally, as mentioned previously, fibers are broken and shortened as a result of the compressing action or any other action which tends to break down fibers while they are separated, wetted, and dispersed.

The present invention recognizes the need for the new mixing method and apparatus and provides a dual shaft plow mixer to meet the objectives described hereinafter. The dual shaft was arranged so that the path of the double wedge working tools would overlap, the working tools mounted on one shaft coming in proximity to the shaft of the second set of working tools, and vice versa. This creates an overlapping zone of interaction. Unlike conventional double arm machines, the direction of rotation of each shaft was reversed, with each set of working tools moving from the bottom of the tank, upward, and overlapping in the centrally located zone of interaction. Conventional double arm machines pull the material down in the center, work it against the walls, and lift it upward at the outside of the tank.

Previously considered impossible mixing effects could be obtained by the functional cooperation of the mixing tools of the dual shaft assemblies of the invention when mounted to create an overlapping zone of interaction, so that a fundamentally new mixing principle is created. The new mixing principle permits extreme accuracy of mixing of all types of materials from dry to semi-solid to viscous liquids, with or without fillers or fibers, providing a uniform shear, uniform work input, and uniform particle temperature. Additionally, this is accomplished efficiently with substantially less energy than other machines, or conversely, with the same energy, the new dual shaft apparatus can overcome higher viscous forces at higher rates of shear. The new principle also permits ease of wetability, separation, and dispersion of fillers and fibers since the movement of the overlapping plows in the zone of interaction creates a lifting and separation effect in comparison to the shearing and compressing action of conventional mixing apparatus.

On characteristic which makes the novel dual shaft mixer and dual shaft "mix principle" so effective is "flow division" or particle division. The inventive apparatus has two main shafts with four double wedge-shaped working tools mounted radially, 90° apart, on each shaft for a total of eight working tools. In impelling the materials charged into the mixer, each divides the material into two parts. Additionally, if any given particle was traced, it would be discovered that by random choice, the given particles could be further divided within the zone of interaction of the overlapping working tools. This additional division increases the total division influences per shaft revolution to 16.

This action results in a mathematical progression of division as in the formula; $D = 2^n$ where $D$ is the total number of divisions (not striations), and $n$ is the number of division influences per minute. If the main shaft speed of the machine was 90 rpm therefore $n$ equals 16 × 90 or 1440.

In the above formula, then $D$ equals $2^{1440}$ or $2.75 \times 10^{433}$. This represents an astronomical number of divisions per minute, and gives the machine the capability of accurate mixing in a time period in seconds for many materials.

To further consider striations, not divisions, the impelling working tool not only divides the material, but also separates the material by a temporary void equal to the working tool width, and this void is immediately replaced with other material in the batch by the combined forces of the force of gravity and centrifugal forces. Therefore, in the above formula, if striations are considered, where S equals the total number of striations, the formula which applies is:

$$S = 3^n, \text{ or } S = 3^{1440} = 1.057 \times 10^{587}$$

or a number even more astronomical than total divisions.

The applicants single shaft double wedge mixer in an actual test, was recognized as the fastest, most accurate mixing apparatus available, having the proven capability of "almost perfect blending" as defined by the School of Pharmaceutical Research, University of Michigan in a period of time of 30 seconds. Tests of the new dual shaft mixing apparatus, with its capability of superior product division, can reduce this time from 30 seconds to fifteen seconds or less.

Still another characteristic of this new mixing principle is radial mixing and inversion in the overlapping zone of interaction. As described previously, and considering each shaft assembly separately, the processed materials will rotationally circulate around the main shaft center, or as a liquid, around the same point, considered to be its hydraulic center. The velocity of individual particles vary in proportion to the distance of that particle from the main shaft center. When the shafts are combined to form a dual shaft mixing apparatus, the result is a functional cooperation of the mixing tools to provide radial inversion of a random basis as previously described. The radial inversion creates a new flow path for half of the materials which randomly start on a figure eight pattern, thereby accelerating the previous low velocity particles in the vicinity of the opposite shaft, and vice versa. The ultimate result is an averaging of particle velocity. The centrifugal forces also cause a radial shifting of material from the main shaft, or hydraulic center, toward the higher velocity displaced particles in the path of the working tools. The significance of this is an extremely uniform shear on all particles as explained later. Also eliminated are tranverse gradients in temperature and composition.

The general material loading of the new mixing apparatus is 60% of total capacity. By test, to determine the working capacity for any given material, it can be charged from 10% to 100% of total capacity. Another characteristic of the new machine is the overlapping zone of interaction, and the influence of the forces of gravity on this zone. When the plow working tools rotate out of the material (assuming that the tank is generally loaded to about 60% of total capacity), coming upward in the center of the mixing apparatus, the forces of gravity cause the material to fall from the high speed working tools, thereby creating a denser, or more active zone in the overlapping region. Additionally, a particle coming in contact with the triangular side of the double wedge-like working tool is imparted with horizontal and vertical components of a resultant force which moves the particle in a transverse direction, and imparts a final velocity which is proportional to the distance to the main shaft center. This action tends to separate the individual particles with the resultant crossflow, or interaction, not only from the double wedge working tools on the same shaft, (as in a single shaft mixer) but also provides a vigorous interaction of particles of varying velocity in the dense overlapping zone of interaction.

The result of the above mentioned actions, namely particle division, radial inversion, uniform work input, and uniform temperature gradient is extreme uniformity of shear. To further understand the novelty of the new mixing apparatus, particularly as it relates to the handling viscous, tacky, semi-solid materials, and with fillers and fibers incorporated, a review of "shear" and "viscosity" is helpful.

Viscosity is a measure of a fluids internal friction. There is a measureable resistance when one layer of fluid is made to move in relation to another. The force to overcome this resistance is the viscous force. A highly viscous, tacky material is one possessing a great deal of internal friction. Newton defined viscosity by considering two parallel planes of liquid of area "A", separated by a distance "dx", and moving at a velocity differential "dv". Newton assumed that the force, F, required to maintain this difference in speed, was proportional to the velocity gradient, dv/dx through the material. He wrote:

$$\frac{F}{A} = n \frac{dv}{dx} \text{ or } n = \frac{F/A}{dv/dx} = \frac{F'}{S} = \frac{\text{shear stress/unit area}}{\text{rate of shear}}$$

where $n$ equals viscosity.

With this in mind, it can be understood why the double wedge shaped working tool is capable of overcoming the extremely high internal friction of highly viscous materials. The double wedge-like tools and their radial arms are spaced either 120° or 90° apart. Double wedge-shaped tools alternately enter the material with the triangular tip efficiently entering first. For up to four working tools, only one of these is fully immersed at any one time.

Shear stress, by definition, is shear force divided by shear area. Most conventional double arm mixers presently in use today have comparatively broad surfaced working tools, and these broad areas are generally welded or cast as part of the main shaft. Heavy power is required to move viscous materials using these broad areas. In comparison, the inventive plow has relatively little area, and additionally, it is held in place by a radial arm with narrow cross section. Operating alternately, and entering the material efficiently, with the same power input of a conventional mixer, the result is considerably higher shear stress. Moreover, the working tool has the ability to overcome the extremely high internal friction of viscous or fibrous materials. Conversely, the new design principle of the dual shaft mixing apparatus permits economy of drive by requiring less horsepower for mixing the same material as other double arm mixers.

Furthermore, the machines according to the present invention, are very well suited for incorporating fillers and fibers such as asbestos, glass, sisal, paper etc. into the highly viscous, tacky materials as hereinbefore mentioned. Hitherto, prior steps were required, for instance, to open pressure packed bales of pre-expanded asbestos fiber, the bales being compressed after willowing to reduce their cubic content for shipping purposes. The action of the dual shaft working tools gently opens and separates these fibers in extremely short periods, eliminating the need for additional equipment. As stated previously, the mixing principle of true product division continues to separate the fibers for wet ability and produce homogeneity. Uniform shear, as previously mentioned, also promotes product homogeneity from the standpoint of its consistency.

Because of the clearances of the working tool, fibers or fillers are not compressed or broken. Also, due to the speed and accuracy of incorporation, the undesirable characteristic of defilamentizing, of glass fiber bundles, for example, is eliminated. This results in a stronger product, and allows the choice of reducing the filler or fiber content for cost purposes, while maintaining the same strength in the product, and assures a proper mixture bulk for weight handling and proportioning requirements of extruders or molding machines.

Additionally, as in the case of a single shaft plow mixer, for heating or cooling purposes, a high "U" value is obtained because of the special action of the underside of the working tool which tends to pull material from the cylinder walls, thereby resulting in excellent heat transfer. With the added capability of the new invention to handle viscous, tacky, semi-solid materials while providing heat through a jacketed source, or with hot gases, it offers problem solving capability as a dryer or reactor, particularly for those materials which require constant, positive, uniform shear circulation as the material passes through the semi-solid stage prior to becoming dry.

Accordingly, it is an object of the present invention to provide a dual shaft (double arm) mixing machine for viscous, tacky, semi-solid materials.

It is another object of the present invention to provide a mixing machine that is capable of mixing viscous, tacky, semi-solids, while providing uniform shear through the novel overlapping plow shafts with the characteristics of positive and constant circulation, particularly for non-Newtonian fluids.

It is another object according to the invention to provide an improved mixing apparatus which is simple in design, reliable in operation and inexpensive in cost.

Other objects and features of the present invention will become apparent from the following detailed description considered in connection with the accompanying drawings which disclose several embodiments of the invention. It is to be understood however, that the drawings are designed for the purpose of illustration only and not as a definition of the limits of the invention.

In the drawings, wherein similar reference characters denote similar elements throughout the several views.

Figure 1:
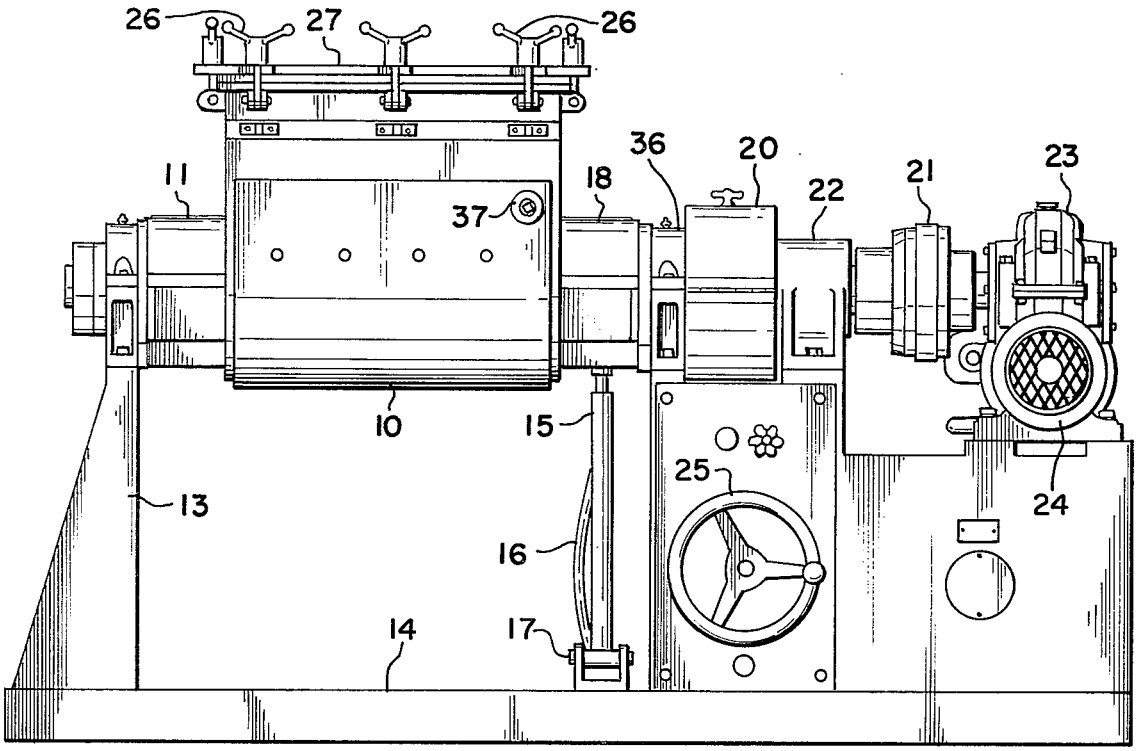
FIG. 1 is a perspective view of the double mixing apparatus according to the invention.
Figure 3:
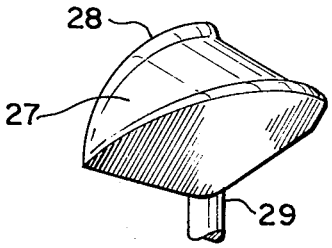
FIG. 3 is a detailed view of a full mixing plow.
Figure 2:
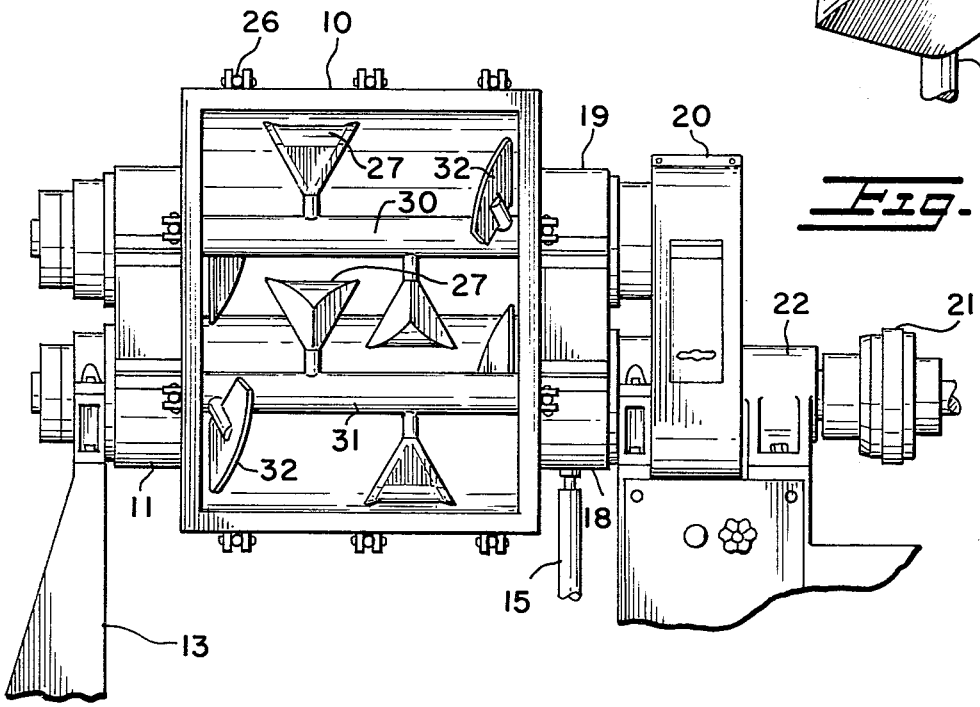
FIG. 2 is a detailed view of the mixing chamber and its drive having its cover removed.

Referring to FIGS. 1–3, there is shown a stationary mixing container or mixing bowl 10 horizontally mounted between pairs of bearings 11 and 12, and 18 and 19. Bearing 11 is coupled to a vertical support 13 whereas bearing 18 is coupled to a hydraulic pivot 15 which is operated by a hydraulic fluid line 16. The opposite end of hydraulic piston 15 is connected to a pivot 17 which is mounted on base 14 of the apparatus.

At the other end of the apparatus is a motor 24 connected to a gear reduction drive 23. The output of gear reduction drive 23 is fed into a coupling 21 and drives a double gear within housing 20 which is supported by bearings 22 and 36. Double gear housing 20 contains at least a pair of gears wherein one of the gears is driven by the shaft connected to the output of coupling 21. This is in turn connected to shaft 31 which is pivoted within mixing container or bowl 10. The driven gear within housing 20 is connected to shaft 30 which is spaced apart and parallel to shaft 31 with respect to each other. Mounted on each of the shafts are a plurality of double mixing tools 27 which have relieved edges 28, and are supported on the end of arms 29. The double wedge tools 27 are disposed within the center portion of shafts 30 and 31, and single wedge tools 32 are mounted at the ends of shafts 30 and 31 adjacent to the walls of the mixing container. The supporting arms are preferably welded or bolted perpendicular to the shafts and are distributed in a helical formation about the circumference of each of the shafts. Full double wedge tools 27 have preferably wedge-shaped or triangularly shaped bodies since mixing elements of a paddle design or broad area will not perform effectively when operated at the equivalent shaft speeds. The sides of the full plows are tapered to merge near their connection to the tool arms.

The single tool along the walls of the container are arranged to have a unilateral action so as to return the material towards the center of the mixing bowl. Shafts 30 and 31 are spaced apart and preferably parallel to each other, so that the mixing elements consisting of the double and single wedges of one shaft will pass in close proximity and overlap the tool assemblies of the other shaft. The shaft rotation is towards the center of the mixing bowl and upward into the zone of interaction so as to provide a radial inversion of the contents. The working tool-like elements lift the material from the mixing container walls and divide the material, moving it unilaterally and bilaterally. The material is also displaced forward into the zone of interaction.

The double and single plows are designed to have a combined width to cover the entire surface of the mixing container so that no surface is uncovered by the path of a tool. The tools are designed to withstand high torque and high moment forces as they move through extremely viscous materials and have to overcome the high internal friction.

The container is preferably constructed of two cylindrically shaped chambers which intersect between the shaft axes to form the bottom. The axes of the shafts are preferably coaxial with the cylinder axes.

The top of the mixing bowl or container can be opened by loosening clamps 26 which are mounted on pivot bolts at the rim opening of the container. After the clamps are opened, a cover plate 27 can be lifted off to expose the entire top surface of the mixing container. The container can then be pivoted by rotating handle 25 which controls the hydraulic valve so that hydraulic cylinder 15 will rotate the mixing container 90° on the axis of shaft 31.

The materials can be mixed on a batch basis, or on a continuous basis through a charging opening at the top. For continuous operation the mixing bowl is generally lengthened so that one end is charged and the opposite end can be used to discharge the mixed materials.

In another embodiment of the invention, mixing container 10 can be jacketed so that a heating or cooling fluid can be inserted through valve opening 37 to maintain a preferred temperature of the contents within the container.

Figure 4:
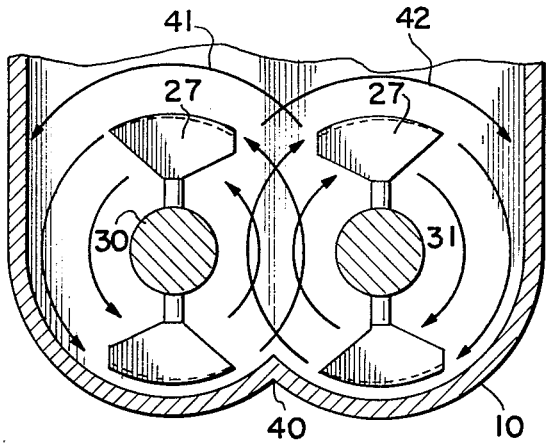
FIGS. 4 and 5 are cross sectional views taken through the mixing chamber for one orientation of the plows.
Figure 5:
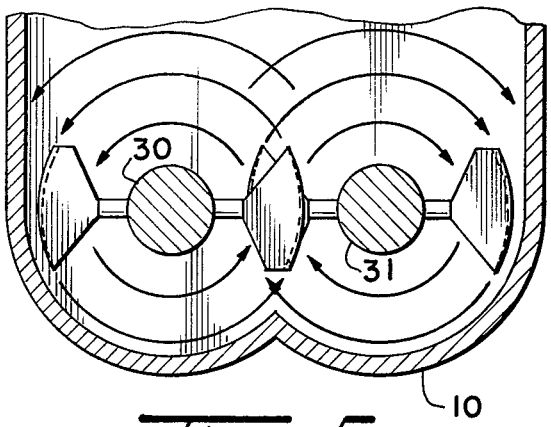

Referring to FIG. 4 there is shown a cross sectional view of the mixing container showing that the container has two cylindrically shaped chambers which converge at center 40. Shaft 30 rotates in the direction of arrow 41 and shaft 31 rotates in the direction of arrow 42. Working tools 27 which are connected to the shafts have their leading edge pointed in a direction of rotation. As the working tools rotate, the viscous material is moved through each of the halves of the mixing chamber. The circular arrows show the velocity paths of the particles of material during the mixing. The rotation of shafts 30 and 31 are designed to move the material upward from the bottom center 40 of the mixing chamber. FIG. 5 shows the interaction of the working tools after 90 degrees of rotation wherein each of the working tools enters the mixing zone of the opposite working tool so that the edges of the plows pass adjacent to each other to maximize the shear forces in the material. This position is also shown in the open chamber of FIG. 2.

Figure 6:
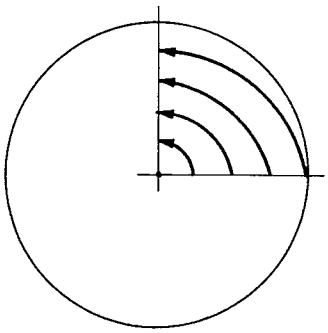
FIGS. 6, 7 and 8 illustrate the interaction of the particles during the mixing process.
Figure 7:
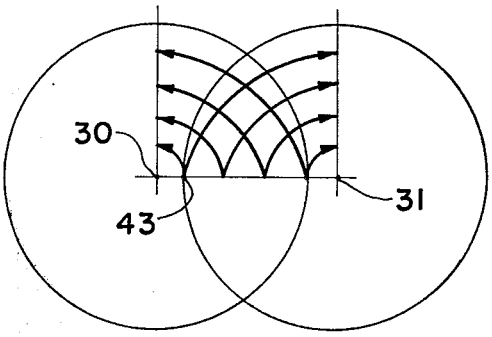
Figure 8:
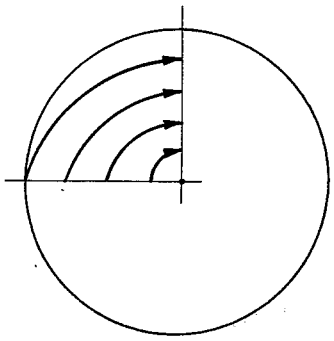

FIGS. 6, 7 and 8 are particle diagrams showing the movement of particles for each of the working tools individually. The velocity of particles which are adjacent to the axis of shaft 30 is much slower than particles that are moved on the outside edges of the working tools. The velocity paths are therefore not uniform for the working tools of either half of the mixing chamber. As shown in detail in FIG. 7, a particle 43 which may be adjacent to shaft 30 has a 50% probability of being carried on a high velocity path along the edge of the working tool driven by shaft 31. There is therefore a random division of 50% of the particles so that they will undergo a change in velocity within the zone of interaction between the axes of shafts 30 and 31. Moreover, there is a centrifugal force which moves the particles away from the axes toward the center of the zone of interaction as the shafts are rotated. Therefore, a particular particle is not only randomly divided during each cycle of mixing, but also shifted within the zone of interaction so that it will experience a different velocity and path of travel during each of the cycles.

Figure 9:
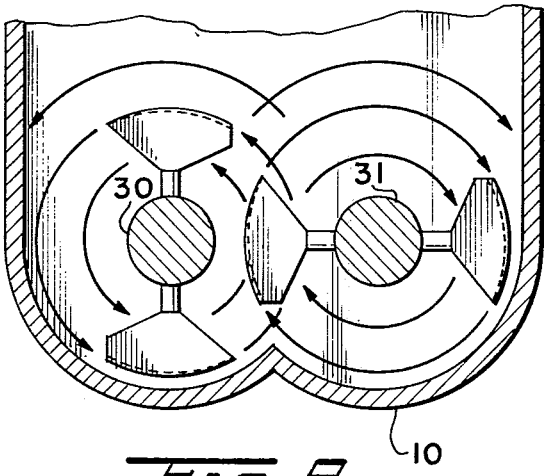
FIGS. 9 and 10 are cross sectional views of the mixing chamber showing a different orientation of the double mixing tools having lower shear forces exerted on the mixing material.
Figure 10:
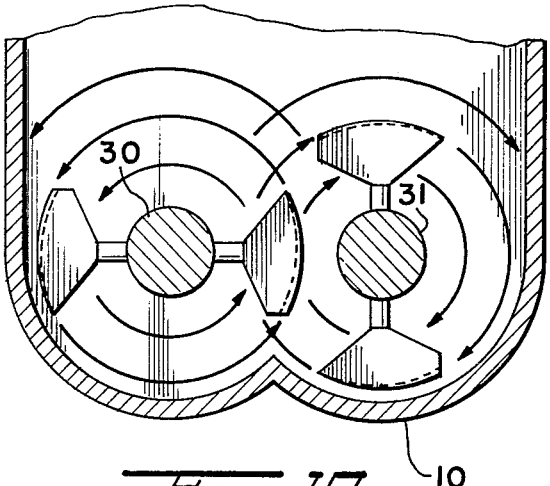

In FIGS. 9 and 10, shaft 30 has been rotated 90° with respect to shaft 31. In this embodiment, the shear forces are not as great since the working tools do not interact with each other in the mixing area.

The double mixer of the present invention has the advantage in that as the material enters the zone of interaction between the two shafts, the material in front of each of the working tools is at its greatest density due to the movement of the working tools and the forces of gravity acting on the material. Thus, the working tools elements will lift and divide the material while it is under its greatest density providing the best possible mixing conditions.

Where the shafts enter the mixing container, suitable shaft packing or air purge seals are provided. The chamber can then be arranged for vacuum or pressure operation. The drive can be made with an electric motor or a hydraulic means. If a hydraulic means is provided, a constant torque hydraulic drive would be efficient since as the material approaches a semi-solid stage, the working tool speed is automatically reduced through the hydraulic drive at no disadvantage. Then, as the material starts to break up, there will be an increase in speed so that there will be a fluidizing action that the mixing is designed for. In the present invention, the plow shaft speeds are generally higher than other double arm mixers by as much as 100%, depending on the nature of the material. Therefore the present invention provides higher rates of shear to material during their mixing. In an embodiment of the invention, the temperatures were measured in all of the eight quadrants of the mixing chamber and found to be identical, confirming the fact that there is uniform work input to all the particles. A temperature rise of the material having a final apparent viscosity of 5,000,000 centipoises was less than 5°F which is indicative of the speed of mixing and the efficiency of the apparatus.

While only a few embodiments of the present invention have been shown and described, it will be obvious to those skilled in the art that many changes and modifications may be made thereunto without departing from the spirit and scope of the invention.

What is claimed is:

1. An apparatus for mixing viscous materials comprising:

a container;

a pair of spaced-apart shafts pivotably disposed through said container, and defining a zone of interaction between the axes of said shafts;

a plurality of double-wedge working tools each comprising two substantially triangular planes inclined relative to each other and connected at one edge thereof, said working tools being connected to the periphery of each shaft in spaced-apart relationship so as to overlap in the zone of interation;

drive means coupled to each of said shafts for moving the shafts and the working tools oppositely with respect to each other so that adjacent working tools of the shafts co-act in mixing the viscous material.

2. The apparatus as recited in claim 1 wherein said container comprises two cylindrically shaped chambers which intersect between the axes of said shafts to form the bottom thereof, the axes of said shafts being disposed along the axes of said intersected cylinders, said chambers including two flat walls at the ends thereof, and a lateral opening on the top surface thereof.

3. The apparatus as recited in claim 2 wherein said container has flat end walls, and said working tools comprise a first plurality of said working tools having said two triangular planes having said one edge pointing in the direction of rotation, and single wedges having a flat profile and mounted on said shafts adjacent to the flat end walls of said container.

4. The apparatus as recited in claim 3 wherein the open side of said chamber includes a cover and a plurality of clamps for sealing the cover to said chamber.

5. The apparatus as recited in claim 3 wherein said drive means comprises a motor coupled to one of said shafts for rotating said shaft in one direction, and a gear drive coupled to the other shaft for rotating said other shaft at the same speed in an opposite direction.

6. The apparatus as recited in claim 5 wherein said shafts are parallel to each other.

7. The apparatus as recited in claim 6 wherein said working tools rotate in a direction to urge the viscous material into the bottom of the container before dividing the material into two paths.

8. The apparatus as recited in claim 5 additionally comprising means for pivoting said container on the axis of one of said shafts so that its contents can be emptied from its top opening.

9. The apparatus as recited in claim 8 wherein said pivoting means comprises a hydraulic cylinder coupled to said container, and a hydraulic pump connected to said cylinder for activating said cylinder to pivot said container.

10. A method of mixing viscous, shear sensitive materials in a double mixing container comprising the steps of:

interacting the material between a pair of oppositely driven shafts in the mixing container, with working tools so that mechanical forces are applied through these working tools to move individual particles and layers of material, in oblique directions, the resultant force having component forces exerted in directions circularly, laterally, and toward the center of the container;

randomly dividing the individual particles by means of the working tool and imparting varying velocity and velocity paths to the particles so as to promote constant and positive recirculation of all particles of the batch;

radially inverting the individual particles of the material so as to change its direction, path of travel and velocity so that mechanical shear forces imparted by the working tool, as well as hydraulic shear forces created by the particles of the material slipping on each other by their different velocities, are averaged over an extremely short period of time;

averaging and making uniform the shear stresses resulting from the mechanical and hydraulic shear forces, for each particle, whereby as a result of the uniform work input, uniform temperature gradient, uniform shear stress, a uniform and predictable viscosity throughout the complete batch of shear sensitive material is provided.

* * * * *